United States Patent [19]

Citron

[11] 4,220,283

[45] Sep. 2, 1980

[54] VEGETATION SPRINKLER HAVING A HAND ADJUSTMENT TO DIRECT THE SPRAY

[75] Inventor: Manning Citron, San Marino, Calif.

[73] Assignee: Champion Brass Mfg. Co., Los Angeles, Calif.

[21] Appl. No.: 45,390

[22] Filed: Jun. 4, 1979

[51] Int. Cl.[3] ..... B05B 15/10

[52] U.S. Cl. ..... 239/205; 239/518; 239/590.3

[58] Field of Search ..... 239/106, 110, 111, 200, 239/201, 203–205, 536, 553, 553.3, 558, 575, 590.3, 598, 599, 521, 523, 524, 518; 277/212 G; 285/11, 369

[56] References Cited

U.S. PATENT DOCUMENTS

| | | | |
|---|---|---|---|
| 3,272,436 | 9/1966 | Hunter | 239/251 X |
| 3,650,478 | 3/1972 | Jones | 239/201 X |
| 3,921,910 | 11/1975 | Hayes et al. | 239/205 |
| 4,132,358 | 1/1979 | Keely | 239/204 |

*Primary Examiner*—Andres Kashnikow
*Attorney, Agent, or Firm*—Huebner & Worrel

[57] ABSTRACT

A pop-up riser in a vegetation sprinkler in which the riser is forced out of a housing by water pressure. The riser has a nozzle at its upper end. The riser is normally held in a retracted position by a coil spring. A serrated ring is fixed either on the housing or riser and resilient tabs extending respectively from the other are engaged with the serrations. Precise spray direction is achieved by relative rotation between the tabs and serrations. The nozzle configuration has an outwardly directed flow passage having a portion of its wall cutaway and has its upper end terminating in a conical wall to achieve an optimum spray pattern . A seal is fitted in the housing so as to surround the riser and so as to engage the riser as it is moved upwardly to extended sprinkling positions.

28 Claims, 16 Drawing Figures

FIG. 5.
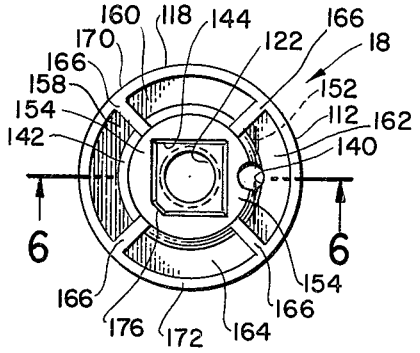
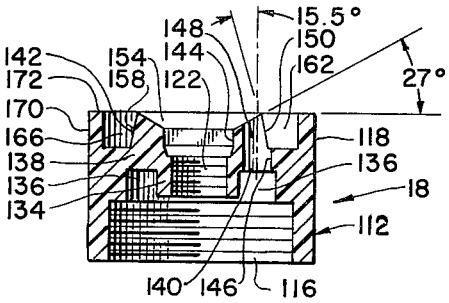
FIG. 6.
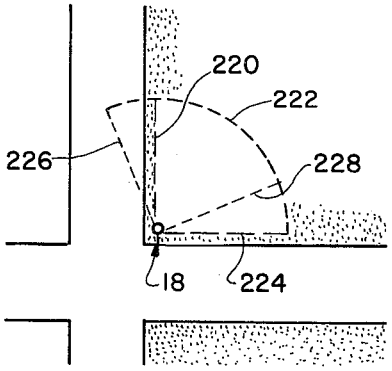
FIG. 11.
FIG. 7.
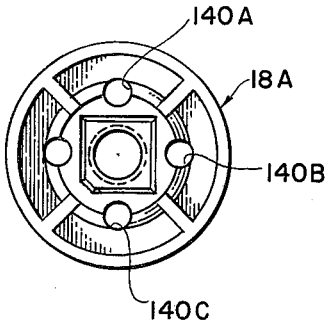
FIG. 8.
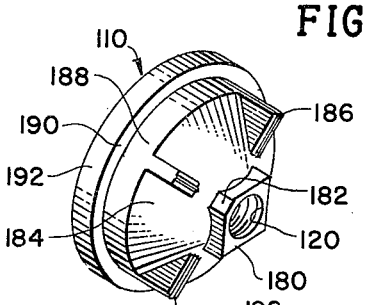
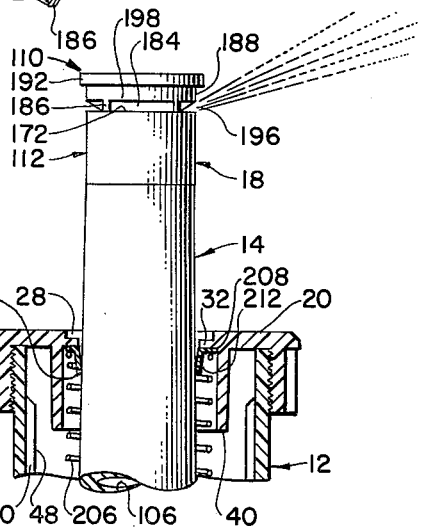
FIG. 9.
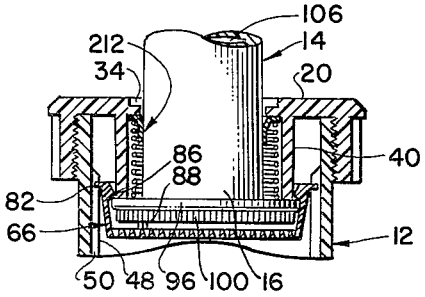
FIG. 10.

FIG. 12.
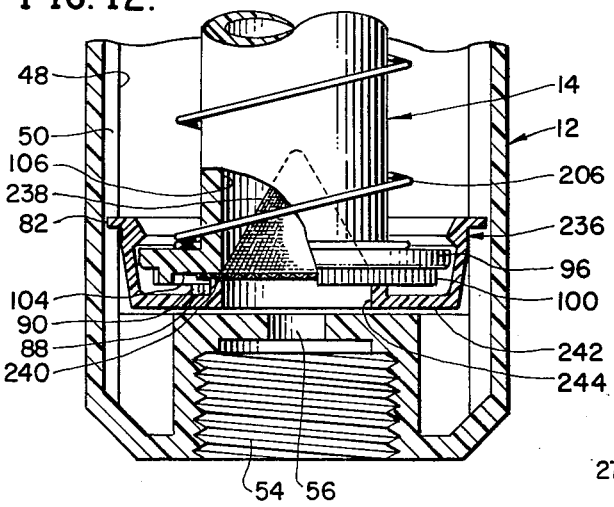
FIG. 13.
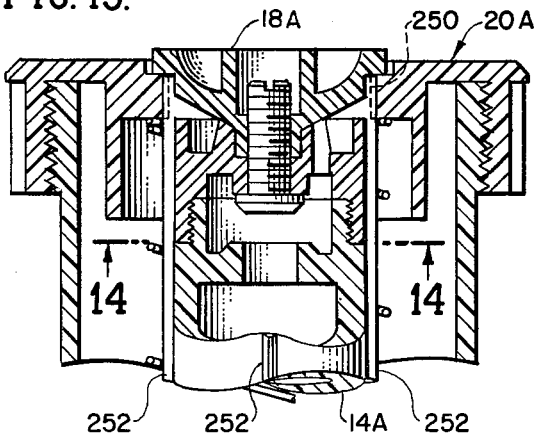
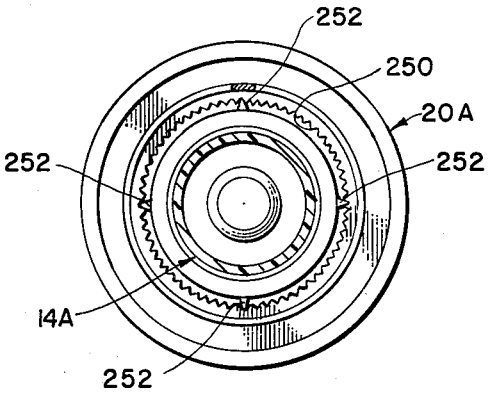
FIG. 14.
FIG. 15.
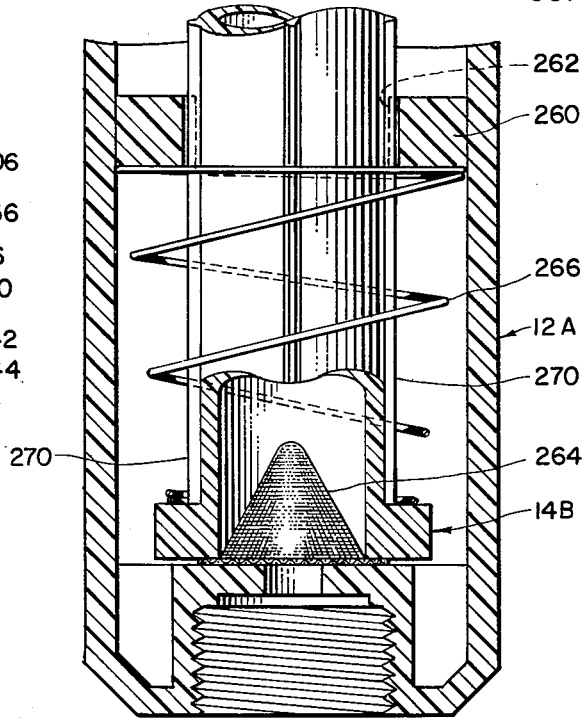
FIG. 16.
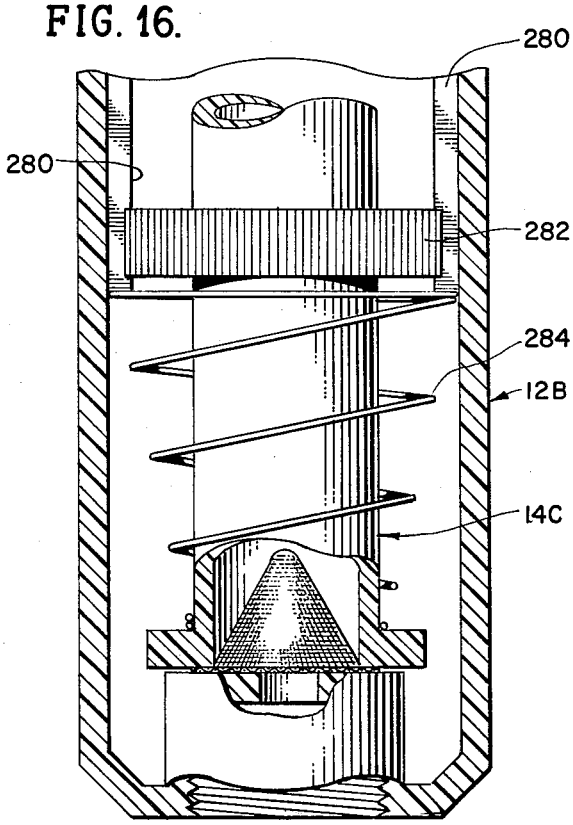

VEGETATION SPRINKLER HAVING A HAND ADJUSTMENT TO DIRECT THE SPRAY

BACKGROUND OF THE INVENTION

In the prior art, pop-up sprinklers were originally made of metal and were fixed against rotation by the shape of the riser in a corresponding opening in the housing. The shape of the riser and the openings were hexagonal, for example. The spray direction adjustment in the metal riser was made by a wrench or other tool by rotating the nozzle.

In the more recent prior art in which risers and the surrounding housings were made of plastic, directional adjustments of the spray were typically made by hand by rotation of the entire sprinkler.

Most prior sprinklers, metal and plastic, have seals on the riser but they don't shut off the flow past the exterior of the riser until it is fully extended.

Also, in the prior art, the nozzle spray construction was rather imprecise in regard to an attainment of optimum spray. Annular slots were positioned in the upstream end of the nozzle and typically were connected into the spray exit where the water was discharged between a lower cylindrical wall and a space thereabove terminated by an upwardly tapering conical wall.

SUMMARY OF THE INVENTION

It is an object of the invention to provide a pop-up lawn sprinkler in which the direction of spray can be easily adjusted by hand and fixed in the adjusted position.

It is another object of the invention to integrate a strainer in the spray direction adjustment device.

It is still another object of the invention to provide a pop-up lawn sprinkler having an improved sealed housing and riser, and an improved nozzle.

It is a further object of the invention to provide a pop-up sprinkler, as described in the preceding paragraphs, in which a seal is positioned between the riser and the housing structure. The seal is adjacent the top of the housing and is spaced from the riser when the riser is in the retracted position. Because the riser is tapered the seal engages the riser when it is about halfway out toward its fully extended position, and remains in sealing contact when the riser is fully extended. This sealing arrangement permits the upward thrust of the riser at a pressure lower than that of the lowest rated operating pressure.

During the initial upward movement of the riser, the seal and riser arrangement permits and facilitates upward and outward flushing of debris between the riser and seal. As the flushing flow increases, the pressure on the seal against the riser reduces the flow as the clearance diminishes, and a venturi-effect is developed by the increased flow velocity through the reduced clearance. Because the seal is annularly positioned around the riser, and there is continuous pressure contact on the underside thereof during operation, there is no leakage even when the riser is dislodged laterally or vertically from the outermost or uppermost position.

It is a still further object of the invention to provide an improved nozzle in which the water strikes an upwardly and outwardly extending conical surface or diverter-cone so that the water is flow-proportioned to be evenly emitted from flow discharges formed in 90° fan-shaped multiples. The flow proportioning is partially accomplished adjacent the point of final water emission by truncating the outermost end of a cylindrical flow passage along an inclined plane.

The outer flow passage through the nozzle is developed in a passage having an inner cylindrical wall and adjacent the outermost portion a lateral part of the wall is cut away at an angle so that the flow of the spray extends laterally or radially outwardly and upwardly through the cutaway. The outer end, cut at the inclined plane, at the cutaway part is closed with the diverter-cone which directs the spray therealong. Spaced below the diverter-cone is a cylindrical wall and the spray travels out of the nozzle through a vertical space between the conical portion and the cylindrical wall. The cylindrical wall is for strengthening and does not affect the spray direction.

It is another object of the invention to position the outermost flow passage centrally between two vertical walls at 90° to each other and extending between the lower level of the cutaway and the upper conical wall. The nozzle may include one, two, three or four sprays.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 5 is a top plan of a lower portion of the nozzle, shown in FIG. 6;

FIG. 6 is a cross-sectional elevational view of a lower portion of the nozzle taken along the line 6—6 in FIG. 5;

FIG. 7 is a view similar to FIG. 5 illustrating a nozzle having four spray discharges for spraying through 360°;

FIG. 8 is a perspective view of the upper portion of the nozzle;

FIG. 9 is an elevational view of the riser and housing with the riser extending about halfway out of the housing and the seal in contact with the circumference of the tapered riser;

FIG. 10 is a fragmentary view of the housing and riser with the latter fully extended and the seal in contact with the riser circumference;

FIG. 11 is a plan view illustrating the adjustment of a nozzle which is adapted to spray through an arc of 90°;

FIG. 12 is an enlarged fragmentary view of another embodiment of the invention having a conical shaped strainer;

FIG. 13 is an enlarged fragmentary view illustrating another embodiment of the invention in which a serrated adjustment ring is at the top of the housing, distinct from that in FIG. 1 where it is shown adjacent the lower end of the housing;

FIG. 14 is a cross-sectional plan view, taken along the line 14—14 in FIG. 13;

FIG. 15 illustrates another embodiment of the invention in which an internal serrated adjusting ring is positioned about halfway up the length of the housing and riser; and FIG. 16 is another embodiment of the invention, similar to that shown in FIG. 15, in which an external serrated ring is on the riser rather than on the housing, as shown in FIG. 15.

DESCRIPTION OF THE PREFERRED EMBODIMENTS

Figure 1:
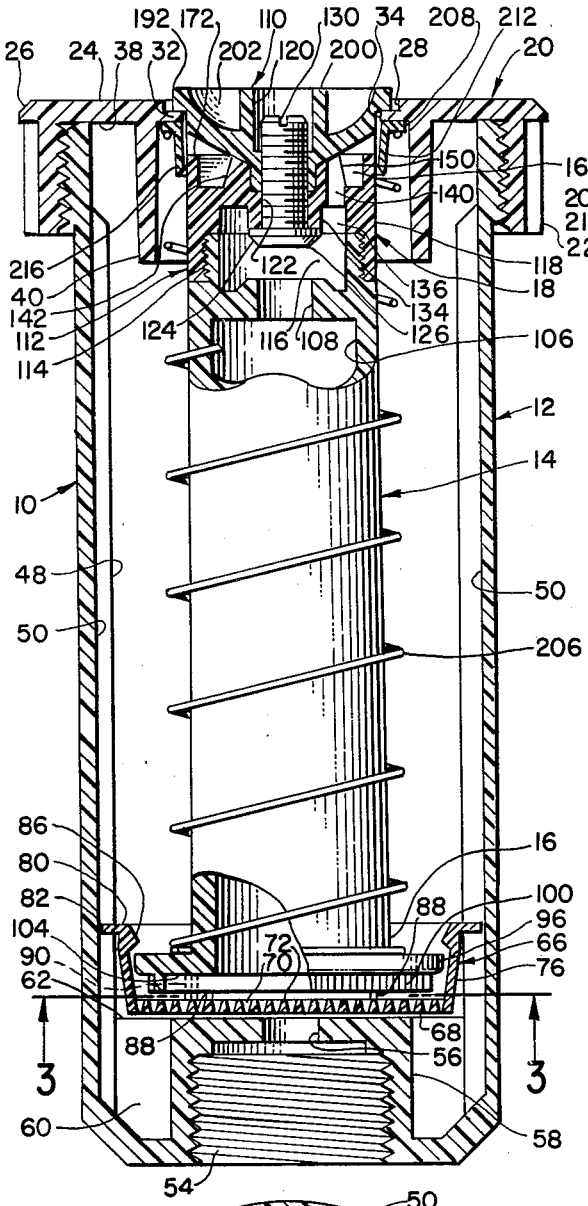
FIG. 1 is a partially cross-sectional elevational view of a nozzle and riser with the latter in the retracted position in a housing.
Figure 2:
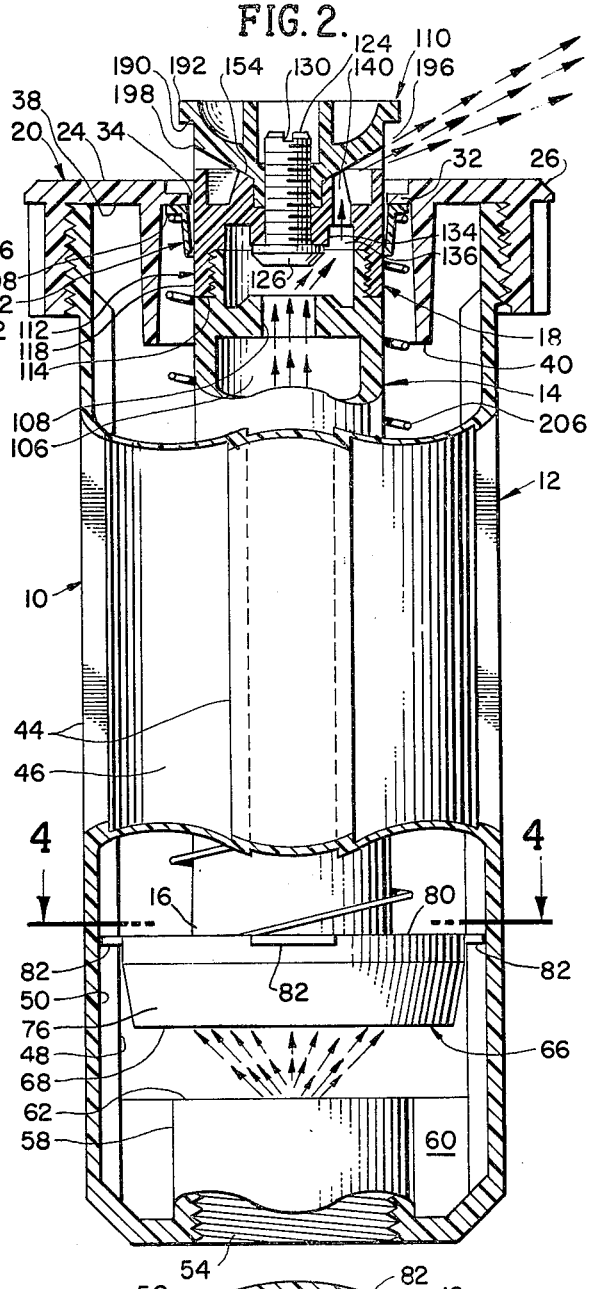
FIG. 2 is an elevational view, similar to FIG. 1, in which the riser and nozzle are extended out of the housing just sufficiently to permit the spray to be discharged.

Referring again to the drawings, there are shown in FIGS. 1 and 2 a pop-up sprinkler, generally designated as 10, comprised of an external, generally cylindrical housing 12 and a generally cylindrical slightly tapered riser 14. The taper extends from a lower larger diameter end 16 of the riser to a smaller diameter upper end just below a nozzle 18. The housing, the riser, and the nozzle are made of molded or extruded plastic parts. The housing 12 has a generally cylindrical, threadedly engaged cap 20, having external axially directed circumferentially spaced, stiffening members 22. An upper surface 24 of the cap is circular and has an annular flange 26 extending above the members 22.

The cap 20 has a central cylindrical opening 28 and a countersunk, inwardly directed annular flange 32 having a cylindrical opening 34. Radially outwardly of the opening 34, extending downwardly from an inner surface 38 of the cap, is an axially directed cylindrical flange 40. As shown in FIGS. 1–4, the outer surface of the housing has four annularly spaced lands and grooves 44 and 46, respectively, and the inner surface of the housing wall has four alternately arranged, relative to the exterior, lands and grooves, 48 and 50, respectively.

At the lower end of the housing there is an enlarged threaded opening 54 adapted to be connected to an underground water supply pipe. Inwardly of the opening 54 is a small diameter water supply passage 56 to the housing. Surrounding the passage 56 is a cylindrical member 58 spaced from the housing wall by webs 60. The member 58 has a plane circular top surface 62.

A strainer or filter, generally designated as 66, has its bottom 68 near the surface 62 when the riser is retracted. The bottom of the strainer has a multiplicity of slots 70 spaced by ribs 72, the water passing into the housing and riser through the slots 70. The bottom of the strainer 68 is circular and extending upwardly therefrom is a conical wall 76 terminating externally in a top annular edge 80. Extending outwardly from the edge 80 are four annularly spaced protrusions 82 which fit into grooves 50 in the housing to prevent the strainer from rotating. Adjacent the inner top of the wall 76 is an inwardly extending angular flange 86. Extending upwardly from the strainer bottom are a plurality of axially directed spacers 88. A plurality of axially directed resilient tabs 90 extend radially inwardly from the wall 76. The strainer is constructed of a molded resilient plastic.

Figure 3:
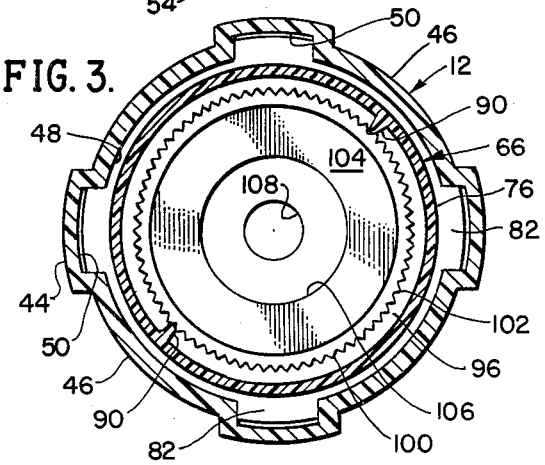
FIG. 3 is a cross-sectional plan view, taken along the line 3—3 in FIG. 1.
Figure 4:
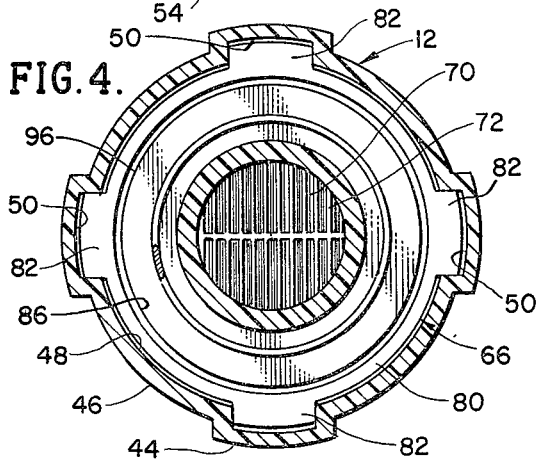
FIG. 4 is a cross-sectional plan view, taken along the line 4—4 in FIG. 2.

At the bottom of the riser there is a cylindrical flange 96 having a diameter greater than the internal diameter of the annular flange 86 and the flange 96 is snap fit therein so that the strainer will move with the riser as it slides upwardly and downwardly in the housing. At the bottom of the flange 96 is a ring 100 having serrations 102 around its circumference. As best seen in FIG. 3, the resilient tabs 90 are engaged with the serrations so that rotation of the riser will position the inner ends of the tabs in one serration to the next thereto. The tabs remain in selected positions in the serration during operation, holding the spray nozzle in a set position.

Inwardly of the serrated ring is a bottom flat surface 104 of the flange 96. At the center of the surface 104 is a cylindrical opening forming the inlet of the internal riser water passage 106, the water passing through the housing passage 56 and the strainer and into the riser of passage 106. Water travels from the passage 106 into a small diameter passage 108 into the nozzle.

The nozzle 18 is shown in detail in FIGS. 1, 2, and 5–8. It is comprised of an upper part 110 and a lower part 112. The lower part is threadedly engaged at 114 to the upper end of the riser and radially, inwardly of the threads is a water passage 116 in communication with the riser passage 108. The exterior 118 of the part 112 is generally cylindrical and does not necessarily have the taper of the riser 14.

Extending vertically through the parts 110 and 112 are aligned cylindrical openings 120 and 122, respectively. The opening 122 is tapped and, as shown in FIGS. 1 and 2, receives a spray adjusting screw 124. The lower end of the screw has a head 126 adapted to seat in the opening 108 at the top of the riser when it is rotated downwardly by means of a screwdriver in an upper slot 130. In FIGS. 1 and 2 the screw is in the fully open position.

Surrounding the lower part of the threaded portion 122 is a cylindrical wall 134 and outwardly thereof is an annular space 136, connected to a generally cylindrical discharge opening 140, FIGS. 5 and 6. The discharge opening 140 is radially outwardly of the threaded opening 122 and has a cylindrical lower portion 146 in a horizontal wall 138. An upper portion 148 of discharge 140 is formed within a generally conical wall 142, having an adjacent upper conical wall and truncating surface 154 and a vertical wall 144 forming part of a central rectangular opening in alignment with opening 122. The portion 148 is open through the conical surface 154 which is at an angle of about 27° with a line perpendicular to the axis of the passage 140.

A part of the wall 142 is cutaway along a line 150, shown in cross section in FIG. 6, to permit opening 140 to discharge radially upwardly. The extent of the arc of the cylinder 140 cut away at the top edge of the wall 154 is indicated as that part of the cylinder outwardly to the right of the phantom line 152 in FIG. 5, line 150 being approximately in the center of the cutaway.

Radially outwardly of the wall 142 are annular grooves, FIGS. 5 and 6, 158, 160, 162 and 164, separated by four vertical walls 166, each consecutive pair being at 90° to each other. The walls 166 extend radially between an outer generally cylindrical strengthening wall 170 and the wall 142. The wall 170 terminates at the top of the lower part of the nozzle. The top edges of the walls 142, 154 and the top 172 of the wall 170 are in the same horizontal plane. The angle of the wall 154 with the top 172 of the wall 170 is about 27° as indicated between the arrows in FIG. 6.

The wall 170 does not affect the spray flow path. The angle of the cutaway line 150 in the upper part of the passage 148 with a line parallel to the axis of the cylinders 146, 148, is about 15.5°, as shown in FIG. 6. The nozzle shown in FIGS. 1, 2, 5, 6 and 9 provides a spray to extend only through one 90° arc.

The rectangular opening 144 has a cutaway corner 176 for proper acceptance of the upper part 110 of the nozzle. The upper part 110 of the nozzle, FIG. 8, has a rectangular protrusion 180 with a cutaway corner 182 adapted to mate with the rectangular opening 144 in the lower part 112 of the nozzle. Extending radially outwardly from the protrusion 180 is a conical surface or diverter-cone 184 adapted to abut the wall 154 at the 27° angle and fix the upper limit of the spray direction. In cross section the spray discharge extends through the 27° angle. The cutaway angle and the 27° angle provide an ideal spray direction or flow discharge.

Extending downwardly from the wall 184 are four vertical walls 186 spaced consecutively at 90° from each other, each being adapted to be positioned on a respective wall 166. Extending axially outwardly from the vertical walls 186 is a cylindrical wall 188 which terminates in an inner flange surface 190 of an annular flange 192. The upper portion 110 fits into the lower portion 112, as shown in FIGS. 1, 2 and 9, and the rectangular portions and respective 90° spaced walls are heat sealed or otherwise adhesively bonded together to make the nozzle portions 110 and 112 integral.

As shown in FIGS. 2 and 9, a space 196 extends between the wall surface 172 and the outer edge 198 of the wall 184 to permit the spray discharge out of the nozzle between the walls at 90° to each other.

The specific construction of the nozzle shown in FIGS. 1, 2, 5, 6, 8 and 9 provides a greatly improved precise spray over that in the prior art. Axially directed water in the discharge passage 148 strikes the diverter-cone wall 184 so that the water is flow proportioned so as to be evenly emitted in the 90° fan shaped multiples. The flow-proportioning is accomplished at the point of final water emission by providing the truncation at the wall 154. This arrangement is complemented by the cutaway along the cross section at the line 150.

The cylindrical space 120 at the outer end of the nozzle is surrounded by a cylindrical wall 200, FIGS. 1 and 2, and outwardly thereof is an annular recess 202 which terminates radially in the flange 192.

Surrounding the riser 14 is a coil spring 206 having its lower end in abutment with the top of the flange 96 and having its upper end acting on the lower surface of the housing flange 32 through an annular flange 208 of a resilient plastic seal, generally designated as 212. The spring holds the riser in the retracted position, FIG. 1, with the flange surface 190 of the nozzle in contact with the outer surface of the flange 32 of the housing.

Extending from the annular seal flange 208 is a truncated conical portion 216 of the seal. When the riser is in the retracted position, FIG. 1, the tapering inner wall of the seal portion 216 is spaced from the generally cylindrical upper end of the nozzle 18. When the force of the water, entering the housing and riser passages, moves the riser outwardly against the force of the spring, the seal portion 216 makes sealing contact with the riser when the riser has been moved about halfway outwardly of the housing, FIG. 9. When the riser is moved to its outermost position, FIG. 10, the seal maintains its continuing but reinforced sealing contact. At this position the flange 96 makes contact with the lower end of the cylindrical wall 40 to prevent further outward movement of the riser.

The sealing action, as described in the foregoing, permits upward thrust of the riser at pressures lower than that of the lowest rated operating water pressure. During the initial upwardly movement of the riser, the seal being spaced therefrom, permits and facilitates upwardly flushing of debris outwardly of the housing between the seal and the riser. As the flushing flow increases, the pressure shuts off the flow due to the combination of diminishing clearances between the seal and riser and the developed venturi-effect created by increased flow velocity between the seal and the riser. With the seal in the positions shown in FIGS. 9 and 10, water pressure on the lower side of the seal prevents leakage even when the riser end is dislodged laterally or vertically from the position shown in both figures. This is because the seal is flexible and is continuously forced against the outer surface of the riser.

As indicated, the nozzle, shown in FIGS. 1, 2, 5, 6, 8, and 9, has only one discharge passage 140, spaced between two walls 166 so as to spray in a 90° arc. The spray from such a nozzle is indicated in FIG. 11 where the proper spray would be generally along the dotted lines 220, 222 and 224. To adjust the spray to be within the lines 220 and 224, the riser is rotated in the housing whereby the serrated ring 100 is rotated with respect to the tabs fixed against rotation in the strainer 66, FIG. 3. A typical design would be so that the rotation of the ring would position each of the tabs into the next serration to adjust the directional radii 220 and 224 through one foot of arc having a radius of 12 feet. Thus, to change the direction of the lines 226 and 228 to coincide with those of the lines 220 and 224, respectively, the riser would be rotated relative to the tabs to the extent of one succeeding serration for each foot of adjustment along the arc 222.

In FIG. 7, the lower portion of a nozzle 18A is shown in plan view. This nozzle is of identical structure as those shown in FIGS. 5 and 6, except that it has four spaced discharges 140A so that it sprays through an arc of 360°. Each of the sprays, as indicated with respect to FIGS. 5 and 6, extend between two vertical walls spaced at 90°. It is clear that where a nozzle is to be used to spray through 180°, two discharges, such as 140B and 140C, would be used.

In FIG. 12 another embodiment of the invention is illustrated. Here, the housing 12 and the riser, as shown in FIGS. 1 and 2, are the same. The difference is in the strainer arrangement in which a ring member 236 has the same basic configuration as the strainer 66 except a strainer 238 is separate from the ring 236. The strainer 238 is conical and extends into the passage 106 of the riser and has an annular flange 240 at its bottom in abutment with the surface 104 within the serrated ring 100. The ring 236 has an annular bottom surface 242 with a central opening 244 providing a passage into the riser. The annular bottom 242 is spaced from the ring 100 by spacers 88 and engages the serrated ring by means of the tabs 90. The ring 236 is prevented from rotating in the housing by means of protrusions 82. The operation of the serrated ring 100 and the tabs 90 is the same as that shown in the embodiment in FIGS. 1 and 2.

In FIGS. 13 and 14 the housing is substantially the same as that in FIGS. 1 and 2 except that in a housing cap 20A, similar to cap 20 in FIG. 1, an internal serrated ring 250 is formed in the cap opening just below the top of the nozzle 18A. Four elongated resilient, circumferentially spaced ribs or tabs 252 extend radially outwardly from a riser 14A which is substantially the same as the riser 14. Here, the ribs 252 engage the serrations of the ring 250 for the length necessary to extend the riser its proper distance out of the housing.

The riser is rotated within the ring to change the ribs from one serration to another to adjust the direction of the spray, as described in regard to FIG. 11.

In FIG. 15 a housing 12A, similar to housing 12 in FIG. 1, has a fixed ring 260 having serrations 262 on its internal circumference. Here, a riser 14B has a conical strainer 264 snugly fitted in the riser bottom opening so that it is secure therein as the riser is moved outwardly of the housing. A coil spring 266 surrounds the riser and has its lower end in abutment with a riser flange and its upper end in abutment with the ring 260.

Four circumferentially spaced elongated ribs or tabs 270 extend radially outwardly of the riser and in the direction of its axis. The ribs 270 extend from the lower end of the riser to above the serrated ring so that they engage the ring for the full movement of the riser in and out of the housing. Here the adjustment of the spray nozzle is made by the rotation of the tabs within the serrations of the ring.

In FIG. 16 a housing 12B, very similar to 12A in FIG. 15, has a plurality of elongated ribs or tabs 280 extending inwardly from its inner surface so as to engage an external serrated ring 282 secured on a riser 14C. The ring 282 is positioned about halfway up the length of the riser, so that the riser is limited in its extension from the housing relative to the position of the ring. The tabs 280 extend to just below the ring 282 and engage the ring for its full movement inwardly and outwardly of the housing. A coil spring 284 has its upper end in abutment with the lower ends of the plurality of tabs 280 and has its lower end on a flange at the bottom of the riser. This embodiment functions in the same manner as those described above, the rotation of the riser and ring 282 being turned with respect to the tabs 280 to position the nozzle so the spray is properly directed. The engagement of the tabs 280 in the serrations, as in the above embodiments, hold the spray in the adjusted position.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. In a pop-up sprinkler, a housing having a lower end for connection to a water supply, an opening in said lower end to permit the flow of water therein, an opening at an upper end opposite said lower end, a riser slidably and rotatably engaged in said upper end and within said housing, said upper end being substantially closed when said riser is therein, a coil spring extending around said riser within the housing, an upper end of said spring acting on a portion associated with said housing, the lower end of said spring acting on a portion associated with said riser, said spring normally holding said riser in a predetermined position substantially within said housing, a spray nozzle forming an upper end on said riser adjacent said upper end of said housing, said nozzle and said housing upper end being adjacent when said spring is holding said riser within said housing, said nozzle having a passage therethrough connected to a passage in said riser extending from a lower end thereof, a relatively small opening in said riser passage to said nozzle passage, said riser having surface area to form sufficient surface thereon within said housing so that water entering said housing lower end opening at a predetermined pressure will move said riser against the force of said spring upwardly to extend the spray nozzle outwardly of said housing, means adjacent said upper end opening of said housing being smaller than said portion associated with said riser to retain a part of said riser within said housing when said water has moved it to extend outwardly of the housing to its fully extended position, the improvement comprising:

first means associated with said riser and second means associated with said housing, said first and second means being engaged for relative rotation in predetermined selected amounts of arc when said riser is hand rotated in said housing for positioning the direction of spray from said nozzle.

2. The invention according to claim 1 in which:

each selected amount of rotation of said riser moves the direction of the spray one foot along the perimeter of an arc twelve feet from said spray nozzle.

3. The invention according to claim 1 in which:

one of said means is a serrated ring and the other of said means is one or more resilient tabs engaged with the serrations.

4. The invention according to claim 1 in which:

said portion associated with said riser is an annular flange extending radially outwardly from the periphery thereof, said first means being a first serrated ring on a circumference associated with said flange, and said second means including one or more resilient tabs extending to engage notches of the serrations between the teeth.

5. The invention according to claim 4 in which:

said flange is adjacent said lower end of said riser, said second means including a second ring secured against rotation in said housing and surrounding said serrated ring, said second ring being secured to said flange for slidable movement therewith in the housing, said tabs extending from an inner surface of said second ring.

6. The invention according to claim 5 in which:

a strainer extends from a lower end of said second ring over the lower end of the riser adjacent a portion of said area surrounding the opening in the riser to prevent solid materials from entering the riser, said strainer having spaced members in contact with said portion of said area surface to space the strainer from the area portion and to permit easy rotation of the riser within the second ring.

7. The invention according to claim 6 in which:

said strainer has narrow slots therethrough forming openings for passage of water into the riser opening.

8. The invention according to claim 1 in which:

said portion associated with said housing is a ring fixed therein and through which said riser extends, said second means being serrations formed on the internal circumference of said ring, and said first means being a plurality of annularly spaced tabs extending radially from said riser to engage the notches of the serrations between the teeth, said tabs being along the direction of the riser a sufficient length to engage said serrations throughout its slidable movement in said housing.

9. The invention according to claim 8 in which:

the portion associated with said riser on which the lower end of the spring acts is an annular flange extending radially outwardly from the lower end of said riser.

10. The invention according to claim 1 in which:

said portion associated with said riser has a ring associated therewith extending radially outwardly from the periphery thereof, said first means being circumferentially arranged serrations on the outer periphery of the ring, said second means being tabs circumferentially arranged around said ring, said tabs being fixed to said housing and engaged with said serrations, said tabs being of a sufficient length along the riser to engage said serrations throughout its slidable movement.

11. The invention according to claim 1 in which:

said nozzle passage has a lower portion joining said riser passage, said nozzle passage having an upper portion having a generally cylindrical inner wall surface, a radially outer part of said inner cylindrical wall being cutaway to provide a flow opening out of the upper passage portion generally transverse to the direction of the axis of the cylindrical wall and to permit flow out of the nozzle in a predetermined direction of spray, and an upper open end of said upper passage portion being conical in cross section and being closed by a complementary conical wall extending toward the periphery of the nozzle.

12. The invention according to claim 11 in which:

said flow opening is inwardly of an outer wall of said nozzle, said conical wall being spaced above and from said outer wall, the space between said last walls providing an opening for the nozzle spray outwardly from the nozzle.

13. The invention according to claim 12 in which:

said conical wall is at an angle of about 27° with an upper end of said outer wall.

14. The invention according to claim 11 in which:

said inner cylindrical wall is cutaway at an angle of about 15.5° with a line parallel to the axis of the upper passage portion, said line being slightly outwardly of said axis in the direction of the spray, said line and axis being in a plane in the approximate center of said spray.

15. The invention according to claim 14 in which:

said plane is positioned in the center between two walls at 90° to each other and extending in the direction of said axis, a first wall surface extending from both sides of said cutaway.

16. The invention according to claim 15 in which:

said first wall surface is generally conical, tapering toward said conical wall.

17. The invention according to claim 11 in which:

said conical wall is at an angle of about 27° with a line perpendicular to the upper passage portion axis and said spray in cross section is discharged through an angle of about 27°.

18. The invention according to claim 1 in which:

said portion associated with said housing on which said upper end of said spring acts is a radially inwardly directed annular flange adjacent the upper end of said housing and extending around said riser, said riser being generally cylindrical and having a slight taper from the lower towards the upper end, an annular seal extending around said riser and having a radially outwardly extending flange in abutment with said housing flange on an inner side thereof, said upper end of said spring being in abutment with said seal flange and acting on said housing flange through said seal flange, said seal having an annular inner member extending downwardly from the inner circumference of the seal flange, said seal being annularly spaced from said riser when said nozzle and said housing upper end are adjacent when said spring is holding said riser within said housing, said inner member of said seal being in sealing contact with said riser when said riser has been forced outwardly of the housing by the water pressure to its fully extended position for spraying, the seal being in contact with a larger diameter portion of the riser taper.

19. The invention according to claim 18 in which:

said inner member of said seal has a downwardly inwardly extending taper.

20. The invention according to claim 18 in which:

said inner member of said seal makes sealing contact with said riser as said riser is being forced outwardly of said housing by water pressure before the riser has been forced out of the housing to its fully extended position for spraying.

21. In a pop-up sprinkler, a housing having a lower end for connection to a water supply, an opening in said lower end to permit the flow of water therein, an opening at an upper end opposite said lower end, a riser slidably engaged in said upper end and within said housing, said upper end being substantially closed when said riser is therein, a coil spring extending around said riser within the housing, an upper end of said spring acting on a portion associated with said housing, the lower end of said spring acting on a portion associated with said riser, said spring normally holding said riser in a predetermined position substantially within said housing, a spray nozzle forming an upper end on said riser adjacent said upper end of said housing, said nozzle and said housing upper end being adjacent when said spring is holding said riser within said housing, said nozzle having a passage therethrough connected to a passage in said riser extending from a lower end thereof, a relatively small opening in said riser passage to said nozzle passage, said riser having surface area to form sufficient surface thereon within said housing so that water entering said housing lower end opening at a predetermined pressure will move said riser against the force of said spring upwardly to extend the spray nozzle outwardly of said housing, means adjacent said upper end opening of said housing being smaller than said portion associated with said riser to retain a part of said riser within said housing when said water has moved it to extend outwardly of the housing to its fully extended position, the improvement comprising:

said nozzle passage having a lower portion joining said riser passage, said nozzle passage having an upper portion having a generally cylindrical inner wall surface, a part of said inner cylindrical wall being cutaway to provide a flow opening out of the upper passage portion generally transverse to the direction of the axis of the cylindrical wall and to permit flow out of the nozzle in a predetermined direction of spray, and an upper open end of said upper passage portion being conical in cross section and being closed by a conical wall extending adjacent the periphery of the nozzle.

22. The invention according to claim 21 in which:

said conical wall is at an angle of about 27° with a line perpendicular to the upper passage portion axis and said spray in cross section is discharged through an angle of about 27°.

23. The invention according to claim 21 in which:

said inner cylindrical wall is cutaway at an angle of about 15.5° with a line parallel to the axis of the upper passage portion, said line being slightly outwardly of said axis in the direction of the spray, said line and axis being in a plane in the approximate center of said spray.

24. The invention according to claim 23 in which:

said plane is positioned in the center between two walls at 90° to each other and extending in the direction of said axis, a first wall surface extending from both sides of said cutaway, said first wall surface is generally conical tapering toward said conical wall.

25. The invention according to claim 24 in which:

said flow opening is inwardly of an outer wall of said nozzle, said conical wall being spaced above and from said outer wall, the space between said last walls providing an opening for the nozzle spray outwardly from the nozzle, an inner surface of said outer wall being spaced outwardly from said first wall surface, and a bottom wall extending between said first wall surface and said inner surface of said outer wall and extending between said two walls at 90°, said two walls at 90° extending between said bottom wall and said conical wall.

26. The invention according to claim 21 in which:

said flow opening is inwardly of an outer wall of said nozzle, said conical wall being spaced above and from said outer wall, the space between said last walls providing an opening for the nozzle spray outwardly from the nozzle.

27. In a pop-up sprinkler, a housing having a lower end for connection to a water supply, an opening in said lower end to permit the flow of water therein, an opening at an upper end opposite said lower end, a riser slidably engaged in said upper end and within said housing, said upper end being substantially closed when said riser is therein, a coil spring extending around said riser within the housing, an upper end of said spring acting on a portion associated with said housing, the lower end of said spring acting on a portion associated with said riser, said spring normally holding said riser in a predetermined position substantially within said housing, a spray nozzle forming an upper end on said riser adjacent said upper end of said housing, said nozzle and said housing upper end being adjacent when said spring is holding said riser within said housing, said nozzle having a passage therethrough connected to a passage in said riser extending from a lower end thereof, a relatively small opening in said riser passage to said nozzle passage, said riser having surface area to form sufficient surface thereon within said housing so that water entering said housing lower end opening at a predetermined pressure will move said riser against the force of said spring upwardly to extend the spray nozzle outwardly of said housing, means adjacent said upper end opening of said housing being smaller than said portion associated with said riser to retain a part of said riser within said housing when said water has moved it to extend outwardly of the housing to its fully extended position, the improvement comprising:

said portion associated with said housing on which said upper end of said spring acts being a radially inwardly directed annular flange adjacent the upper end of said housing and extending around said riser, said riser being generally cylindrical, and having a slight taper from the lower towards the upper end, an annular seal extending around said riser and having a radially outwardly extending flange in abutment with said housing flange on an inner side thereof, said upper end of said spring being in abutment with said seal flange and acting on said housing flange through said seal flange, said seal having an annular inner member extending downwardly from the inner circumference of the seal flange, said seal being annularly spaced from said riser when said nozzle and said housing upper end are adjacent when said spring is holding said riser within said housing, said inner member of said seal being in sealing contact with said riser when said riser has been forced outwardly of the housing by the water pressure to its fully extended position for spraying, the seal being in contact with a larger diameter portion of the riser taper.

28. The invention according to claim 27 in which:

said inner member of said seal makes sealing contact with said riser as said riser is being forced outwardly of said housing by water pressure before the riser has been forced out of the housing to its fully extended position for spraying.

* * * * *

REEXAMINATION CERTIFICATE (536th)

United States Patent [19]

Citron

[11] B1 4,220,283

[45] Certificate Issued Jul. 22, 1986

[54] VEGETATION SPRINKLER HAVING A HAND ADJUSTMENT TO DIRECT THE SPRAY

[75] Inventor: Manning Citron, San Marino, Calif.

[73] Assignee: Champion Brass Mfg. Co., Los Angeles, Calif.

Reexamination Request:
No. 90/000,894, Oct. 30, 1985

Reexamination Certificate for:

| | |
|---|---|
| Patent No.: | **4,220,283** |
| Issued: | **Sep. 2, 1980** |
| Appl. No.: | **45,390** |
| Filed: | **Jun. 4, 1979** |

[51] Int. Cl.[4] ..... B05B 15/10

[52] U.S. Cl. ..... 239/205; 239/518; 239/590.3

[56] References Cited

U.S. PATENT DOCUMENTS

| | | | |
|---|---|---|---|
| 3,655,132 | 4/1972 | Rosic | 239/206 |
| 3,785,565 | 1/1974 | Perry et al. | 239/206 |
| 3,955,764 | 5/1976 | Phaup | 239/206 |

*Primary Examiner*—Andres Kashnikow

[57] ABSTRACT

A pop-up riser in a vegetation sprinkler in which the riser is forced out of a housing by water pressure. The riser has a nozzle at its upper end. The riser is normally held in a retracted position by a coil spring. A serrated ring is fixed either on the housing or riser and resilient tabs extending respectively from the other are engaged with the serrations. Precise spray direction is achieved by relative rotation between the tabs and serrations. The nozzle configuration has an outwardly directed flow passage having a portion of its wall cutaway and has its upper end terminating in a conical wall to achieve an optimum spray pattern. A seal is fitted in the housing so as to surround the riser and so as to engage the riser as it is moved upwardly to extended sprinkling positions.

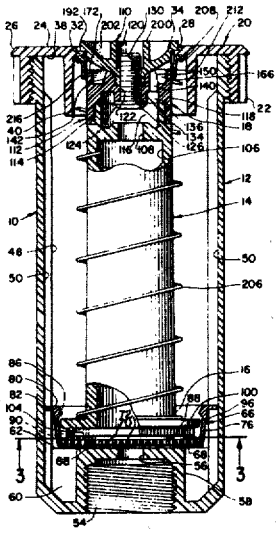

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–28 is confirmed.

* * * * *